US009956605B2

(12) United States Patent
Rao et al.

(10) Patent No.: US 9,956,605 B2
(45) Date of Patent: May 1, 2018

(54) SWAGING DIE HOLDER

(71) Applicant: Suprajit Engineering Ltd., Bangalore, Karnataka (IN)

(72) Inventors: Subba Narahari Rao, Bangalore (IN); Pancham Koorana Anand, Bangalore (IN)

(73) Assignee: Suprajit Engineering Ltd., Bangalore (IN)

( * ) Notice: Subject to any disclaimer, the term of this patent is extended or adjusted under 35 U.S.C. 154(b) by 0 days. days.

(21) Appl. No.: 15/364,747

(22) Filed: Nov. 30, 2016

(65) Prior Publication Data

US 2017/0297083 A1 Oct. 19, 2017

(30) Foreign Application Priority Data

Apr. 19, 2016 (IN) ..... 201641013576

(51) Int. Cl.

| | |
|---|---|
| ***B21D 41/00*** | (2006.01) |
| ***B21J 13/03*** | (2006.01) |
| ***B21J 9/06*** | (2006.01) |
| ***B21K 1/06*** | (2006.01) |
| ***B21D 41/04*** | (2006.01) |

(52) U.S. Cl.

CPC ..... *B21J 13/03* (2013.01); *B21D 41/00* (2013.01); *B21D 41/04* (2013.01); *B21J 9/06* (2013.01); *B21K 1/06* (2013.01)

(58) Field of Classification Search

CPC ..... B21J 13/03; B21J 9/06; B21J 1/06; B21K 1/06; B21D 41/04; B21D 41/00

USPC ..... 72/462, 402

See application file for complete search history.

(56) References Cited

U.S. PATENT DOCUMENTS

| | | | | | |
|---|---|---|---|---|---|
| 684,216 | A | * | 10/1901 | Garner et al. | B21D 39/046 72/402 |
| 1,322,584 | A | * | 11/1919 | Kraft | B21D 39/04 72/402 |
| 1,761,521 | A | * | 6/1930 | Eastman | H01R 43/058 285/256 |
| 3,116,683 | A | | 1/1964 | Krembel, Jr. | |
| 3,568,495 | A | * | 3/1971 | Duffield | B21D 41/00 72/402 |
| 3,823,597 | A | * | 7/1974 | Hanback | B21D 39/046 29/237 |
| 4,995,289 | A | | 2/1991 | Bakermans | |
| 5,253,506 | A | * | 10/1993 | Davis | B21D 39/048 72/402 |
| 5,600,990 | A | | 2/1997 | Kelly | |

(Continued)

*Primary Examiner* — David B Jones

(74) *Attorney, Agent, or Firm* — Blueshift IP, LLC; Robert Plotkin

(57) ABSTRACT

The present invention discloses a swaging die holder for the flexible shaft operations. In the preferred embodiment, the swaging die holder comprises of an elliptical die holder slot, a stress relief slot, a radius curve, a recess and an insert. The die holder slot at top of the die holder allows each die holder to mount to the machine. The insert is adapted through the recess at the bottom of each die holder and designed to produce the different output profiles at the end of the flexible shaft. The insert is made of HSS material with cobalt content to achieve optimal life. The insert is further re-grinded or re-sharpened for same or other profile applications of the flexible shaft.

10 Claims, 4 Drawing Sheets

(56) References Cited

U.S. PATENT DOCUMENTS

| | | | | |
|---|---|---|---|---|
| 5,715,723 | A * | 2/1998 | Owens | B21D 39/048 29/237 |
| 6,016,682 | A | 1/2000 | Tannhauser et al. | |
| 8,020,424 | B2 * | 9/2011 | Suzuki | B21D 39/04 29/508 |
| 2005/0061052 | A1 * | 3/2005 | Schrock | B21D 39/048 72/402 |

* cited by examiner

SWAGING DIE HOLDER

TECHNICAL FIELD OF THE INVENTION

The present invention relates to a segmented swaging die holder which is designed to produce required shapes or profiles and sizes for a flexible shaft to drive the seeder unit gearbox.

BACKGROUND OF THE INVENTION

The die holders are designed to various specifications and dimensions. The die holders are used in swaging operations of the flexible shaft. The swaging is a process of altering a given shape into a desired shape and dimension by cold forming process using a swaging dies. The die holders are designed to achieve the different shapes and sizes to the flexible shafts to suit for various industrial applications such as automobile industry, engineering industry, construction, etc.

Various types of conventional die holders used for swaging process are known in the prior art. The U.S. Pat. No. 3,116,683 A describes the die holder. In the cited patent document, the holders are each designed to hold a number of standard individual steel stamps or type. Three embodiments are provided including a hand holder, a holder that is designed to fit into the ram of a press, and a holder which is adapted to be carried by a marking machine. The novel features of this invention are contained in each of the aforesaid three embodiments. The essential feature of each embodiment being the provision of a cavity or pocket at the lower end of the holder which is adapted to receive one or more stamp or type inserts and a novel lock plate or latch which is provided to hold one or more inserts in a predetermined fixed position in the holder. The insert(s) may be quickly changed when a different marking is required to be stamped on the next part.

The U.S. Pat. No. 6,016,682 A describes the swaging apparatus for surgical needles. In the cited patent document, the swaging apparatus includes at least a first die and a second die. The first die has a first member, which includes a first surface, and a second member, that includes a second surface. The second member is movable relative to the first member between an extended position, in which the second surface extends beyond the first surface, and a retracted position, in which the second surface does not extend beyond the first surface. The second die has at least one surface and is movable relative to the first die between a remote position and an adjacent position. When the second die moves relative to the first die from the remote position towards the adjacent position, the second member of the first die is caused to move from the extended position towards the retracted position, and the surfaces of the first and second dies cooperate with one another so as to swage a surgical needle positioned between the first and second dies. The second member of the first die is movable to the retracted position when the second die abuts the first die. In this manner, surgical needles of many different types or sizes can be swaged by the swaging apparatus.

The U.S. Pat. No. 4,995,289 A describes the die assembly having improved insert retaining system and having reversible die inserts. In the cited patent document, the die assembly comprises a die plate having one or more die inserts therein. The die plate has a recess within which the insert is positioned. The die opening in the insert extends normally of the oppositely directed major surfaces of the insert so that the insert can be reversed. The original obverse surface of the insert thus becomes the reverse surface and the original reverse surface becomes the obverse surface. The necessity of sharpening the die insert in the conventional manner is thus eliminated. Also disclosed is an improved system for mounting die inserts in a die assembly.

The U.S. Pat. No. 5,600,990 A describes the metal extrusion die stack and method. In the cited patent document, the steel extrusion apparatus includes an improved die stack with direct cone geometry. The die stack includes a die holder with removable and replaceable die inserts. The die inserts are made from a high strength material while the die holder is made of a less expensive, traditional material. A hot metal billet is extruded through an orifice provided in the die insert of the die holder. The die stack assembly is retained as an assembled unit as the extrusion container is moved out of contact with the assembly and the butt end of the metal billet is discarded. The die stack assembly is then again located on the extrusion container as a unit to begin another extrusion cycle.

The claimed die holder apparatus as described above, does not disclose the use of the re-grinded or re-sharpened inserts at the bottom of the die holders, which are treated with cryogenic or heat or sub-zero temperatures to avoid distortion in shape or profile during operating condition. Typically, the die holder apparatus does not use the packing slip when the insert face is worn out during the operations. Typically, in conventional die holders the stress developed at mounting points are high and lead to crack or breakage of slots. The claimed die holders need to be replaced when there is occurrence of chip off and clash during sliding and swaging operations.

Hence, there is need for reusable and replaceable insert mounted at the bottom of the swaging die holder, which is designed to produce required shapes or profiles and sizes for the flexible shaft to drive the seeder unit.

SUMMARY OF THE INVENTION

The present invention overcomes the drawbacks in the prior art and provides a swaging die holder for the flexible shaft operations. In the preferred embodiment, the swaging die holder comprises of a die holder slot, a stress relief slot, a radius curve, a recess and an insert. The die holder slot at top of the die holder. The die holder slot allows each die holder to mount to the machine. The stress relief slot is designed at holder position of each die holder to avoid the crack or breakage at mounting surface of the die holder. The radius curve at the corner of the die holder avoids chipping off and clashing during sliding operation of the flexible shaft. The recess is extended longitudinally throughout the bottom of each die holder. The insert is adapted through the recess at the bottom of each die holder. The insert at the bottom is designed to produce the different output profiles at the end of the flexible shaft.

In a preferred embodiment of the invention, the die holder slot at top of each die holder is in elliptical shape.

In a preferred embodiment of the invention, the insert is made of High-Speed Steel (HSS) material with cobalt content to achieve optimal life.

In a preferred embodiment of the invention, the insert is further increased in length than the actual required length to avoid chipping off at edges and corners due to stress concentration at the end of flexible shafts.

In a preferred embodiment of the invention, the insert at the bottom is designed to one or more profiles and sizes as per the user(s) requirement.

In a preferred embodiment of the invention, the die holder are treated with cryogenic or heat or sub-zero temperatures to avoid distortion in shape or profile at the end of the flexible shaft during operating condition.

In a preferred embodiment of the invention, the die holders are varied in numbers depending on the required shape and size at the end of flexible shaft.

In a preferred embodiment of the invention, the recess is in the shape of dove tail 105*a* to accommodate the insert 106.

In another embodiment of the invention, die holder further comprises of at-least one packing slip, wherein the packing slip is placed in the between the recess and the insert, wherein the packing slip is placed when the insert face is worn out during the swaging operation of the flexible shaft.

The present invention avoids the complete replacement of die holder when there is occurrence of chip off and clash during sliding and swaging operations. The invented die holder uses reusable and replaceable insert at the bottom of the die holder. The insert at the bottom may be replaced or re-sharpened when there is chip off or breakage at the bottom of the die holder during swaging operations of the flexible shaft and thereby avoiding the complete replacement of the die holder.

The present invention provides a die holder which is simple, resource efficient, and cost effective. The invention may be used in machineries, which are used for the swaging purpose.

The designed flexible shaft is used to drive a gearbox to impart necessary torque to equipment like harvester or any other such industrial applications in the engineering, construction or the automotive industries.

It is to be understood that both the foregoing general description and the following details description are exemplary and explanatory and are intended to provide further explanation of the invention as claimed.

BRIEF DESCRIPTION OF THE DRAWINGS

The foregoing and other features of embodiments will become more apparent from the following detailed description of embodiments when read in conjunction with the accompanying drawings. In the drawings, like reference numerals refer to like elements.

DETAILED DESCRIPTION OF THE INVENTION

Reference will now be made in detail to the description of the present subject matter, one or more examples of which are shown in figures. Each embodiment is provided to explain the subject matter and not a limitation. These embodiments are described in sufficient detail to enable a person skilled in the art to practice the invention, and it is to be understood that other embodiments may be utilized and that logical, physical, and other changes may be made within the scope of the embodiments. The following detailed description is, therefore, not be taken as limiting the scope of the invention, but instead the invention is to be defined by the appended claims.

The present invention discloses a swaging die holder for the flexible shaft operations. In the preferred embodiment, the swaging die holder comprises of an elliptical die holder slot, a stress relief slot, a radius curve, a recess and an insert. The die holder slot at top of the die holder allows each die holder to mount to the machine. The insert is placed through the recess at the bottom of each die holder and designed to produce the different output profiles at the end of the flexible shaft. The insert is made of HSS material with cobalt content to achieve optimal life. The insert is further re-grinded or re-sharpened for same or other profile applications of the flexible shaft.

The present invention avoids the complete replacement of die holder when there is occurrence of chip off and clash during sliding and swaging operations. The invented die holder uses reusable and replaceable insert at the bottom of the die holder. The insert at the bottom may be replaced or re-sharpened when there is chip off or breakage at the bottom of the die holder during swaging operations of the flexible shaft and thereby avoiding the complete replacement of the die holder.

Figure 1:
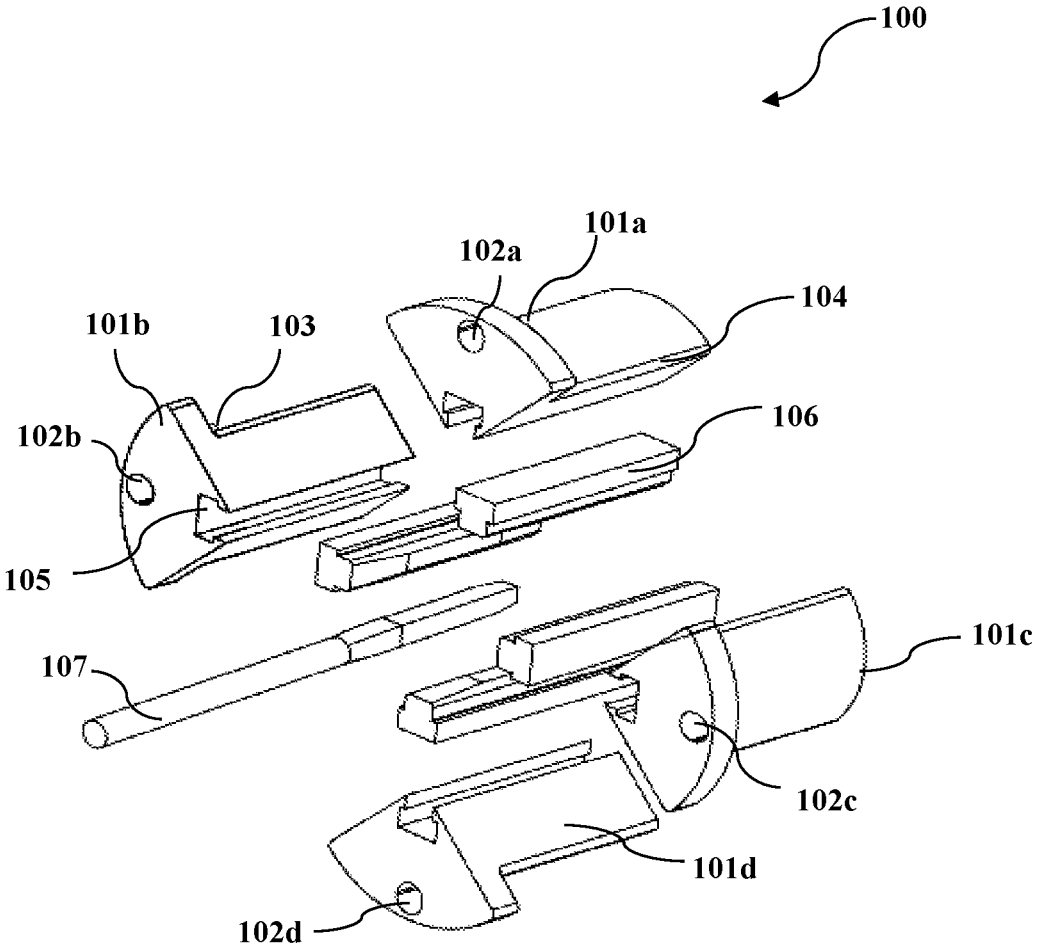
FIG. 1 illustrates an exploded view of a swaging die holder, according to one embodiment of the invention.

FIG. 1 illustrates an exploded view of a swaging die holder, according to one embodiment of the invention. In the preferred embodiment, the exploded view comprises of four die holders (101*a*, 101*b*, 101*c* and 101*d*). The die holder (101*a*) comprises of an elliptical die holder slot (102*a*, 102*b*, 102*c* and 102*d*), a stress relief slot (103), a radius curve (104), a recess (105) and an insert (106). The elliptical die holder slot (102) is located at top of the die holder. The die holder slot (102) provides easy mounting of the die holders (101*a*, 101*b*, 101*c* and 101*d*) to mount to the swaging machine. The stress relief slot (103) on the top of the die holder (101*a*, 101*b*, 101*c* and 101*d*) on the periphery therein. The stress relief slot (103) uniformly distributes the stress concentration and thereby reducing the chances of a die holder breakage due to an impact force, during a swaging operations. The radius curve (104) at the corner of the die holder (101*a*, 101*b*, 101*c* and 101*d*) avoids chipping off and clashing during a sliding operation of a flexible shaft. The recess (105) is created at the bottom of the die holder (101*a*, 101*b*, 101*c* and 101*d*). The recess (105) is in the shape of a dove tail (105*a*) to accommodate the insert (106). The recess (105) is extended longitudinally throughout the bottom of each die holder (101*a*, 101*b*, 101*c* and 101*d*). The dove tail shape recess (105*a*) at the bottom of the die holder holds the insert (106) from falling off therein during the swaging operation. The insert (106) is inserted through the recess at the bottom of the die holder (101*a*, 101*b*, 101*c* and 101*d*) and designed to produce the one or more output shapes at an end of a flexible shaft (107). The insert (106) is made of HSS material with a cobalt content to increase a lifespan therein. The insert (106) may be further increased in length than an actual required length to avoid a chipping off at edges and corners due to a stress concentration during an operation of swaging at the end of the flexible shaft (107). In the preferred embodiment, the insert (106) at the bottom is designed to one or more shapes and sizes as per a user (s) requirement. The die holders (101*a*, 101*b*, 101*c* and 101*d*) are treated with a cryogenic or heat or sub-zero temperature to avoid distortion in shape or profile at the end of the flexible shaft (107) during an operating condition. The die holders (101*a*, 101*b*, 101*c* and 101*d*) are made of D2 or any die steel material to withstand heavy load and operating cycles.

In further embodiment, the die holders 101*a*, 101*b*, 101*c* and 101*d* may vary in numbers depending on the required shape and size at the end of flexible shaft 107.

In one embodiment, the insert 106 is further re-grinded or re-sharpened for same or other profile applications of the flexible shaft.

Figure 2:
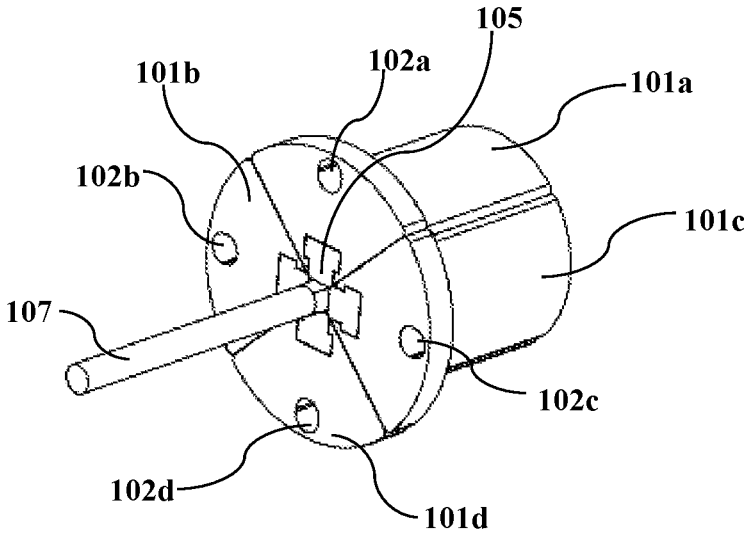
FIG. 2 illustrates the perspective view of the swaging die holder, according to one embodiment of the invention.

FIG. 2 illustrates the perspective view of the swaging die holder, according to one embodiment of the invention. In the preferred embodiment, the perspective view shows four die holders 101*a*, 101*b*, 101*c* and 101*d*, the dove tail shape recess 105 and the elliptical shape die holder slot 102*a*, 102*b*, 102*c* and 102*d*. The four die holders 101*a*, 101*b*, 101*c* and 101*d* are conjoined each other and attached to the machine for swaging operation of the flexible shaft 107.

Figure 3:
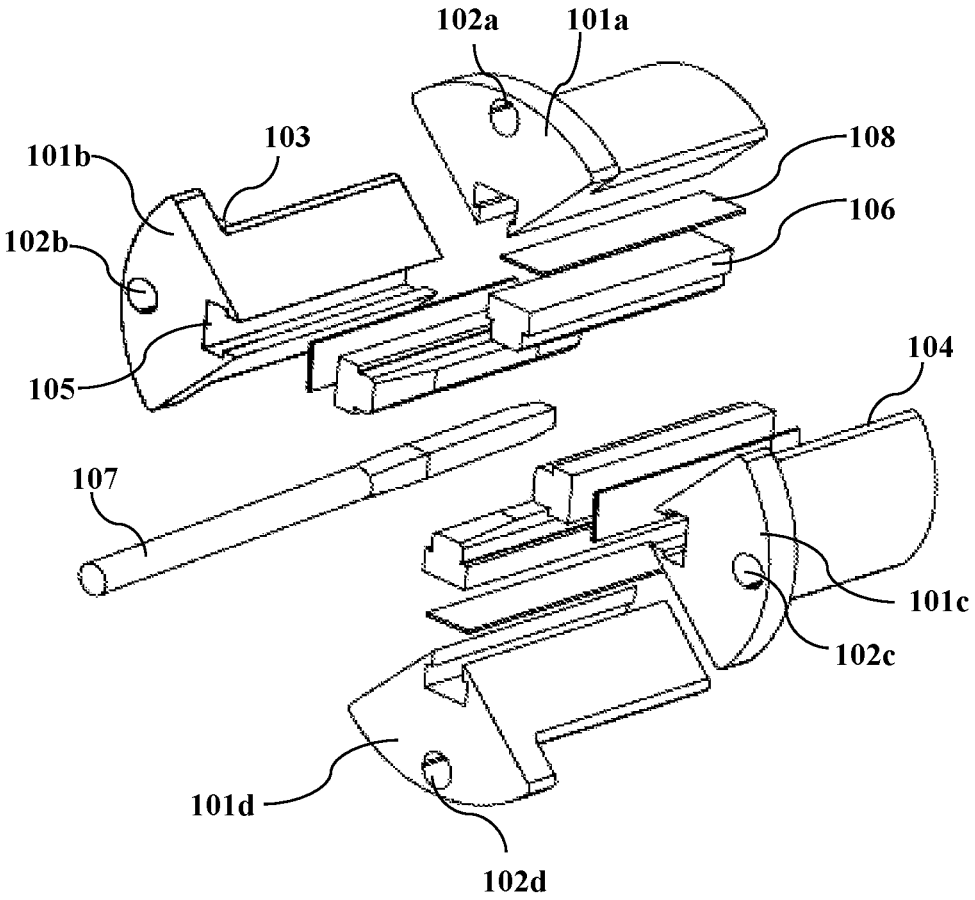
FIG. 3 illustrates an exploded view of the swaging die holder with a packing shim, according to one embodiment of the invention.

FIG. 3 illustrates an exploded view of the swaging die holder with a packing shim, according to one embodiment of the invention. In the preferred embodiment, the exploded view comprises of four die holders (101*a*, 101*b*, 101*c* and 101*d*). Each die holder (101*a*) comprises of an elliptical die holder slot (102), a stress relief slot (103), a radius curve (104), a recess (105), an insert (106) and a packing slip (108). The elliptical die holder slot (102) is located at top of each die holder. The die holder slot (102) provides easy mounting of the die holders (101*a*, 101*b*, 101*c* and 101*d*) to mount to the swaging machine. The stress relief slot (103) is the die holder (101*a*, 101*b*, 101*c* and 101*d*). The stress relief slot (103) uniformly distributes the stress concentration and thereby reducing the chances of the die breakage due to the impact forces, during the swaging operations. The radius curve (104) at the corner of the die holder (101*a*, 101*b*, 101*c* and 101*d*) avoids chipping off and clashing during the sliding operations of the flexible shafts. The recess (105) is created at the bottom of the die holder (101*a*, 101*b*, 101*c* and 101*d*). The recess (105) is in the shape of the dove tail to accommodate the insert (106). The dove tail shape recess (105) at the bottom of each die holder holds the insert (106) from falling off therein during the swaging operation. The recess (105) is extended longitudinally throughout the bottom of each die holder (101*a*, 101*b*, 101*c* and 101*d*). The insert (106) is inserted through the recess at the bottom of each die holder (101*a*, 101*b*, 101*c* and 101*d*) and designed to produce the different output profiles at the end of the flexible shaft (107). The insert (106) is made of HSS material with cobalt content to achieve optimal life. The insert (106) may be further increased in length than the actual required length to avoid chipping off at edges and corners due to stress concentration during the operation of swaging at end of the flexible shaft (107). In the preferred embodiment, the die holders (101*a*, 101*b*, 101*c* and 101*d*) comprises of packing slip (108), which is placed in the between the recess (105) and the insert (106). The packing slip (108) is placed when the insert face (106) is worn-out during swaging operation of the flexible shaft. The insert (106) at the bottom is designed to one or more shapes and sizes as per the user(s) requirement. The die holders (101*a*, 101*b*, 101*c* and 101*d*) are treated with the cryogenic or heat or sub-zero temperatures to avoid distortion in shape or profile at the end of the flexible shaft (107) during the operating condition.

In one embodiment, the insert 106 working area surfaces are mirror finished to avoid friction, stress and resistance between material elongations during pressing operations of the flexible shaft.

Figure 4:
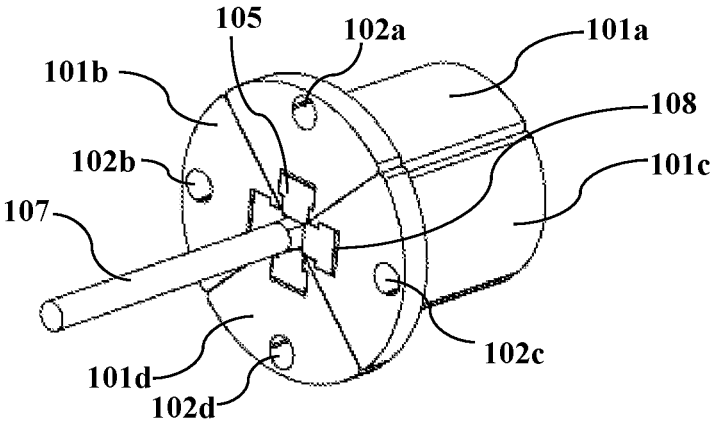
FIG. 4 illustrates the perspective view of the swaging die holder with the packing shim, according to one embodiment of the invention.

FIG. 4 illustrates the perspective view of the swaging die holder with a packing shim, according to one embodiment of the invention. In the preferred embodiment, the perspective view shows four die holders 101*a*, 101*b*, 101*c* and 101*d*, the packing slip 108, the dove tail shape recess 105 and the elliptical shape die holder slot 102. The four die holders 101*a*, 101*b*, 101*c* and 101*d* are conjoined each other and attached to the machine for swaging operation of the flexible shaft.

The present invention avoids the complete replacement of die holder when there is occurrence of chip off and clash during sliding and swaging operations. The invented die holder uses reusable and replaceable insert at the bottom of the die holder. The insert at the bottom may be replaced or re-sharpened when there is chip off or breakage at the bottom of the die holder during swaging operations of the flexible shaft and thereby avoiding the complete replacement of the die holder.

The designed flexible shaft is used to drive a gearbox to impart necessary torque to equipment like harvester or any other such industrial applications in the engineering, construction or the automotive industries.

The present invention provides a die holder which is simple, resource efficient, and cost effective. The invention may be used in machineries, which are used for the swaging purpose.

It is to be understood, however, that even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

We claim:

1. A swaging die holder comprises:

a. at-least one die holder slot (102*a*, 102*b*, 102*c* and 102*d*) at a top of the die holder (101*a*, 101*b*, 101*c* and 101*d*), wherein the die holder slot (102*a*, 102*b*, 102*c* and 102*d*) allows the die holder (101*a*, 101*b*, 101*c* and 101*d*) to mount to a machine;

b. a stress relief slot (103) on the top of the die holder (101*a*, 101*b*, 101*c* and 101*d*) on the periphery therein, wherein the stress relief slot (103) uniformly distributes a stress concentration and thereby reducing a chance of a die holder (101*a*, 101*b*, 101*c* and 101*d*) breakage due to an impact forces, during a swaging operations;

c. a radius curve (104) at a corner of the die holder (101*a*, 101*b*, 101*c* and 101*d*) avoids a clashing between the die holders (101*a*, 101*b*, 101*c* and 101*d*) in a closed condition, during a sliding operation of a flexible shaft;

d. a recess (105) extended longitudinally throughout at a bottom of the die holder (101*a*, 101*b*, 101*c* and 101*d*); and e. an insert (106), wherein the insert (106) is inserted through the recess (105) at a bottom of each die holder (101*a*, 101*b*, 101*c* and 101*d*), wherein the insert (105) at the bottom is designed to produce one or more output shapes at an end of a flexible shaft (107).

2. The swaging die holder as claimed in claim 1, wherein the die holder slot (102) at the top of each die holder (101*a*, 101*b*, 101*c* and 101*d*) is an elliptical shape.

3. The swaging die holder as claimed in claim 1, wherein the insert (106) is made of a High-Speed Steel (HSS) material with a cobalt content to increase the lifespan therein.

4. The swaging die holder as claimed in claim 1, wherein the insert (106) is further increased in length than an actual required length to avoid a clashing at edges and corners due to stress concentration at the end of the flexible shafts.

5. The swaging die holder as claimed in claim 1, wherein the insert (106) is further re-grinded or re-sharpened for same or other profile applications of a flexible shaft.

6. The swaging die holder as claimed in claim 1, wherein the insert (106) at the bottom is designed to one or more shapes and sizes as per a user(s) requirement.

7. The swaging die holder as claimed in claim 1, wherein the die holders (101*a*, 101*b*, 101*c* and 101*d*) are treated with a cryogenic or heat or sub-zero temperature to avoid distortion in shape or profile at an end of a flexible shaft, during an operating condition.

8. The swaging die holder as claimed in claim 1, wherein a die holder (101*a*, 101*b*, 101*c* and 101*d*) is varied in numbers depending on a required shape and size at the end of flexible shaft.

9. The swaging die holder as claimed in claim 1, wherein the swaging die holder further comprises of at-least one packing slip, wherein the packing slip (108) is placed in between the recess (105) and the insert (106), wherein the packing slip (108) is placed when an insert (106) face is worn out, during a swaging operation of a flexible shaft.

10. The swaging die holder as claimed in claim 1, wherein the recess (105) is in a shape of dove tail (105*a*) to accommodate the insert (106).

* * * * *